US009752374B2

(12) United States Patent
Fu

(10) Patent No.: US 9,752,374 B2
(45) Date of Patent: Sep. 5, 2017

(54) ASSEMBLY HAVING LIFTABLE LID AND MOVABLE HINGE MODULE THEREOF

(71) Applicants: LITE-ON ELECTRONICS (GUANGZHOU) LIMITED, Guangzhou (CN); LITE-ON TECHNOLOGY CORPORATION, Taipei (TW)

(72) Inventor: Ping-Kun Fu, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 129 days.

(21) Appl. No.: 14/564,254

(22) Filed: Dec. 9, 2014

(65) Prior Publication Data

US 2015/0159423 A1 Jun. 11, 2015

(30) Foreign Application Priority Data

Dec. 11, 2013 (CN) ..... 2013 1 0674775

(51) Int. Cl.
*E05B 63/20* (2006.01)
*E06B 3/50* (2006.01)
(Continued)

(52) U.S. Cl.
CPC ..... *E06B 3/509* (2013.01); *E05D 3/022* (2013.01); *E05F 1/105* (2013.01); *E06B 7/32* (2013.01); *E05B 61/00* (2013.01); *E05B 63/22* (2013.01); *E05C 17/085* (2013.01); *E06B 3/38* (2013.01); *E06B 3/385* (2013.01); *Y10S 292/04* (2013.01); *Y10S 292/11* (2013.01)

(58) Field of Classification Search
CPC ..... E05C 17/085; E06B 3/509; E05B 61/00; E05B 63/22; Y10S 292/04; Y10S 292/11; Y10T 16/5323; Y10T 16/5408
USPC ..... 292/1, 332; 296/24.34, 37.8, 37.14
See application file for complete search history.

(56) References Cited

U.S. PATENT DOCUMENTS 342,404 A * 5/1886 Vollrath et al. ..... A45C 5/02 16/350
3,479,104 A * 11/1969 Kobryner ..... E06B 3/385 312/100
(Continued)

FOREIGN PATENT DOCUMENTS

EP 0846585 A2 * 6/1998 ..... B60K 15/05

*Primary Examiner* — Carlos Lugo
(74) *Attorney, Agent, or Firm* — Li & Cai Intellectual Property (USA) Office

(57) ABSTRACT

An assembly has a liftable lid and a movable hinge module. The assembly includes an object having an opening, a lid rotatably arranged upon the opening, and a hinge module. The hinge module includes at least a shaft connected to the lid, a base, and at least a latch. The shaft is connected to the base and along with the base defines a rotating axis. The rotating axis is movably arranged between a close position and an open position. The latch fastens the lid over the opening. When the rotating axis is at close position, the lid closes upon the opening as a close state. When the rotating axis moves away from close position, the lid rotates and moves away from the opening to an open state. The rotating axis moves to open position.

17 Claims, 10 Drawing Sheets

(51) Int. Cl.

| | |
|---|---|
| ***E05F 1/10*** | (2006.01) |
| ***E05D 3/02*** | (2006.01) |
| ***E06B 7/32*** | (2006.01) |
| *E05B 63/18* | (2006.01) |
| *E06B 3/38* | (2006.01) |
| *E05B 63/22* | (2006.01) |
| *E05B 61/00* | (2006.01) |
| *E05C 17/08* | (2006.01) |

(56) References Cited

U.S. PATENT DOCUMENTS 4,424,606 A * 1/1984 Sorimachi ..... E05F 1/1261 16/223
4,811,984 A * 3/1989 Hempel ..... B60K 15/05 296/202
4,896,189 A * 1/1990 Akuzawa ..... G03B 27/6228 355/75
5,020,845 A * 6/1991 Falcoff ..... B60R 7/04 224/311
5,507,423 A * 4/1996 Fischer ..... B60R 7/10 224/281
5,603,540 A * 2/1997 Shibao ..... E05B 77/06 292/128
5,845,954 A * 12/1998 DePue ..... B60R 7/06 16/82
5,893,478 A * 4/1999 Maruoka ..... B60R 7/04 16/354
6,003,927 A * 12/1999 Korber ..... B60N 2/464 296/37.8
6,325,427 B1 * 12/2001 Daoud ..... E05C 3/34 220/325
6,702,357 B2 * 3/2004 Joerg ..... B60K 15/05 220/86.2
6,866,319 B2 * 3/2005 Hupfer ..... B60R 7/04 224/282
6,959,972 B2 * 11/2005 Cude ..... E05D 15/56 16/351
7,163,248 B2 * 1/2007 Adams ..... B60R 7/04 296/24.34
7,168,750 B2 * 1/2007 Hutek ..... B60N 2/464 296/24.34
7,390,045 B2 * 6/2008 Tiesler ..... B60R 7/08 296/24.34
7,406,747 B2 * 8/2008 Chol ..... H04N 1/00519 16/239
7,766,407 B2 * 8/2010 Nakaya ..... B60N 3/08 292/334
7,780,203 B2 * 8/2010 Jan ..... E05C 19/022 292/19
7,815,227 B2 * 10/2010 Jan ..... H05K 5/0221 292/19
8,118,333 B2 * 2/2012 Lee ..... E05B 63/24 292/163
8,814,225 B2 * 8/2014 Yang ..... G11B 33/027 292/1
2003/0071047 A1 * 4/2003 Harada ..... E05D 3/18 220/835
2003/0080131 A1 * 5/2003 Fukuo ..... B60R 7/04 220/264
2005/0031390 A1 * 2/2005 Orozco-Abundis H04N 1/00554 399/380

* cited by examiner

ASSEMBLY HAVING LIFTABLE LID AND MOVABLE HINGE MODULE THEREOF

BACKGROUND

1. Field of the Invention

The instant disclosure relates to an assembly having a liftable lid and a movable hinge module thereof; in particular, to a movable hinge module disposed between a lid and an object for pivotally connecting the lid that is capable of rotating with respect to the object over an opening of the object in an open and close manner.

2. Description of Related Art

Many products have a lid that can be opened in respect to a case. A hinge mechanism is disposed between the lid and the case. A conventional hinge mechanism is shown in FIGS. 1 and 2. A shaft 81 of a lid 8 is arranged underneath the bottom face of the lid 8, such that the shaft is not exposed to the exterior. However, to allow adequate space for the lid 8 to swing upward when opening, a gap is required between the lid 8 and an opening of a case 10, such that the lid 8 can flip 90° upwardly as shown in FIG. 2. This way produces an apparent gap L which affects the aesthetic of the product.

BRIEF SUMMARY OF THE INVENTION

The instant disclosure provides an assembly having a liftable lid to reduce its aesthetic effect caused by a hinge module. The hinge module is hidden underneath the lid when the assembly is at a close state. Because the hinge module is movable, when the lid opens, the hinge module is raised to create more space for the lid to openly rotate.

According to one exemplary embodiment of the instant disclosure, the assembly having a liftable lid includes an object having an opening, a lid rotatably arranged upon the opening in an open and close manner and a hinge module. The hinge module includes at least one shaft connected to a bottom face of the lid, a base and at least a latch. The base is selectively at an inner side of a surface of the object or an outer side of the surface of the object by a force. The shaft is rotatably connected to the base, and the shaft and the base collectively define a rotating axis. The rotating axis is movably arranged between the inner side of the surface of the object that is a close position and the outer side of the surface of the object that is an open position. The latch fastens the lid at the opening. When the rotating axis is at the close position, the lid closes upon the opening as a close state. When the rotating axis moves away from the close position, the lid rotates along the rotating axis and moves away from the opening to an open state. The rotating axis correspondingly moves to the open position.

In addition, the instant disclosure further provides a movable hinge module that is pivotally connected to the object over the opening so as to be able to rotate for opening or closing the lid. Meanwhile, when the lid closes upon the opening, the overall aesthetic is not compromised.

According to another embodiment of the instant disclosure, a movable hinge module that is pivotally connected to the object over the opening for opening or closing the lid in rotation is provided. The hinge module includes at least one shaft connected to a bottom face of the lid, a base and at least a latch. The base is selectively at an inner side of a surface of the object or an outer side of the surface of the object by a force. The shaft is rotatably connected to the base, and the shaft and the base collectively define a rotating axis. The rotating axis is movably arranged between the inner side of the surface of the object that is a close position and the outer side of the surface of the object that is an open position. The latch fastens the lid at the opening. When the rotating axis is at the close position, the lid closes upon the opening as a close state. When the rotating axis moves away from the close position, the lid rotates along the rotating axis and moves away from the opening to an open state and the rotating axis correspondingly moves to the open position.

The hinge module is movable to allow pivotal connection between the lid and the object, such that the lid can arrange upon, in other words close or open upon, the opening of the object in rotation. When the lid closes upon the opening, the lid sinks below the surface of the object, such that the hinge module does not affect the object aesthetic. When the lid opens, the hinge module shifts above the object surface to allow more rotation space.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE INVENTION

Figure 1:
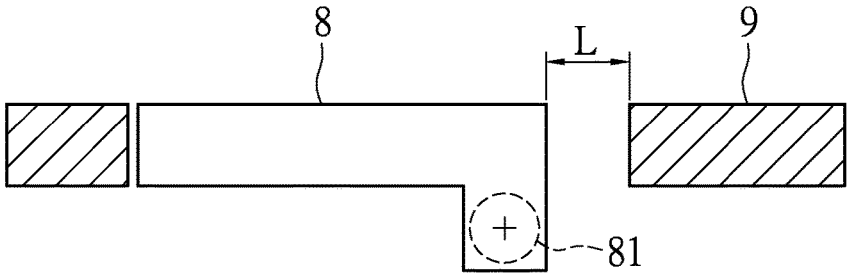
FIG.1(PRIOR ART)
FIG. 1 and FIG. 2 show side views of a conventional assembly with a liftable lid.
Figure 2:
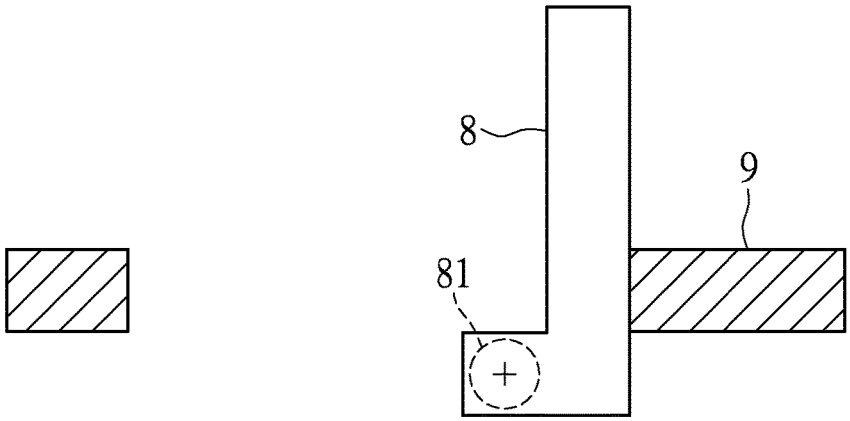
FIG.2(PRIOR ART)

The aforementioned illustrations and following detailed descriptions are exemplary for the purpose of further explaining the scope of the instant disclosure. Other objectives and advantages related to the instant disclosure will be illustrated in the subsequent descriptions and appended drawings.

In the following description, when it comes to the number or the like, unless specifically described, the instant disclosure is not limited to the number mentioned. Throughout the present specification, expression of relative position such as "top", "bottom", "left", "right", "front", "rear" etc, are used solely for convenience and clarity as oriented in the drawings. They are in no way intended to be limited as to the orientation of use of the instant disclosure described.

First Embodiment

Figure 3:
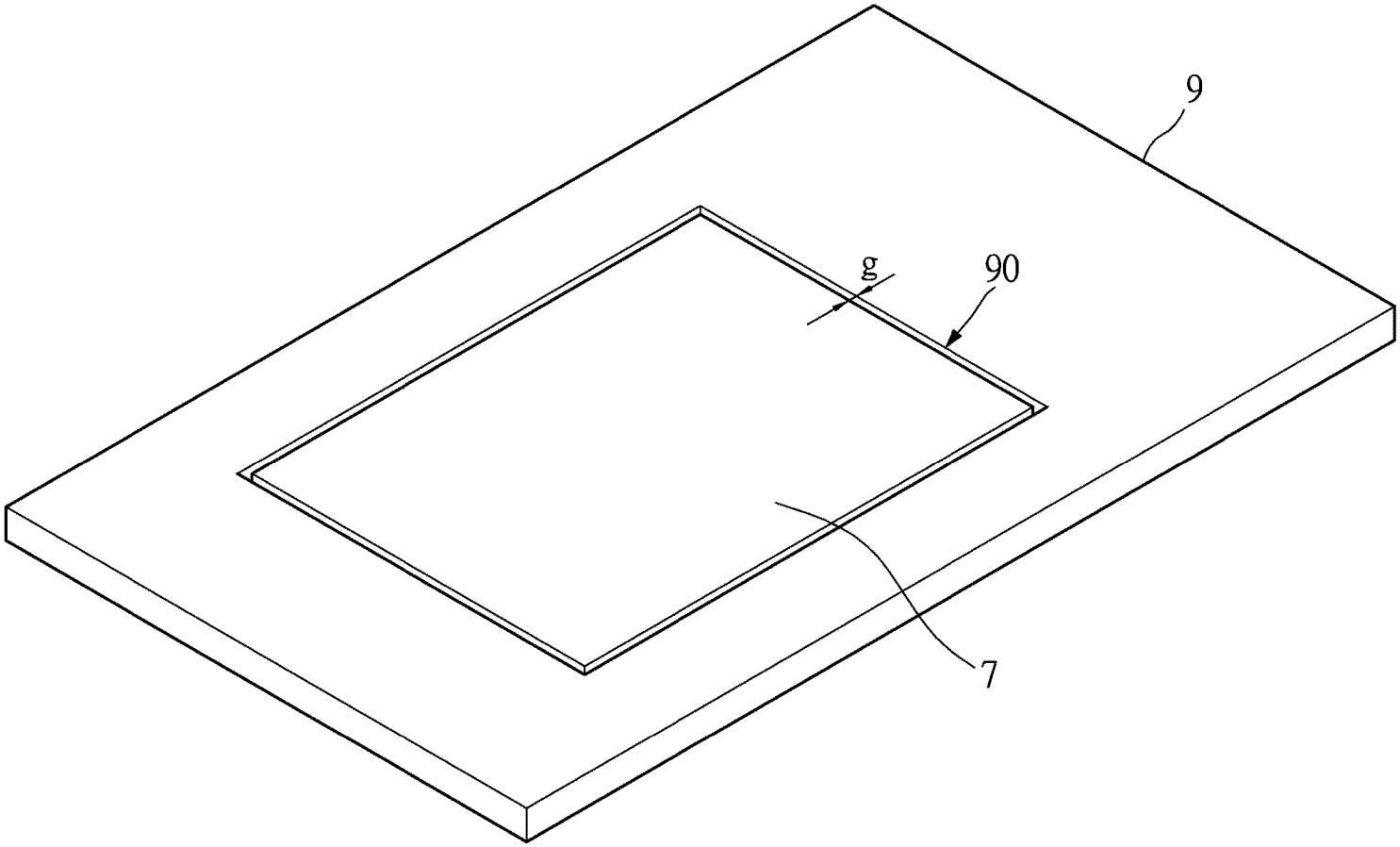
FIG. 3 is a perspective view showing an assembly having a liftable lid in accordance with an embodiment of the instant disclosure.
Figure 4:
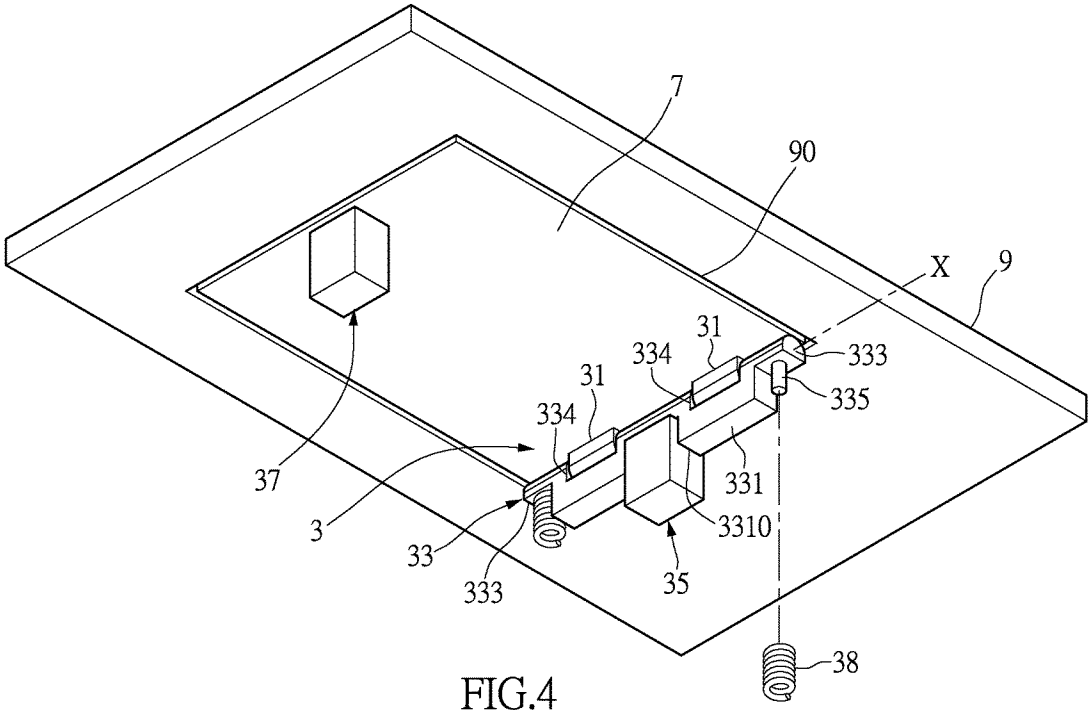
FIG. 4 is another perspective view showing an assembly having the liftable lid in accordance with an embodiment of the instant disclosure.

Please refer to FIGS. 3 and 4 showing perspective views of an assembly having a liftable lid from different angles. The assembly having the liftable lid includes an object 9, a lid 7 and a movable hinge module 3 disposed on the object 9 to allow the lid 7 to rotatably open or close. The object 9 includes an opening 90. The object 9 of the instant disclosure is suitable to any structure having the lid 7, for example, a door plate, a panel, a case, a wall or the like. The object 9 and the lid 7 may be configured to any geometrical configuration and the instant disclosure is not limited to the instant embodiment. The lid 7 is disposed on the object 9 over the opening 90 in a rotatable opening-closing manner. A gap g between the lid 7 and the object 9 does not expose the hinge module 3, and the gap g is not too large to affect the aesthetic. Preferably, when the lid 7 is at a close state, the circumferential region of a surface of the lid 7 is flushed with a surface of the object 9. When the lid 7 is at an open state, a portion of the lid 7 is positioned above the surface of the object 9.

The hinge module 3 of the instant embodiment includes a pair of shafts 31 connected to a bottom face of the lid 7 and a base 33. The base 33 is movable in relation to the surface of the object 9. By a force, the base 33 may be positioned to the inner side of the surface of the object 9 or the outer side of the surface of the object 9. The force may come from an external force from a user, gravity, elasticity or a kinetic component. According to the drawing of the instant embodiment, the base 33 may shift upwardly or downwardly in relation to the object 9. When the hinge module 3 is employed in a vertical object, the base 33 may shift laterally right or left into and out of the inner side of the object 9. The pair of shafts 31 is rotatably connected to the base 33, and the shafts 31 and the base 33 collectively define a rotating axis X. In other words, the pair of shafts 31 can rotate along the rotating axis X in relation to the base 33. The hinge module may be, for example, a conventional hinge, a torsion hinge, an elastic hinge, a stepping hinge or the like and the instant disclosure is not limited thereto.

Figure 5:
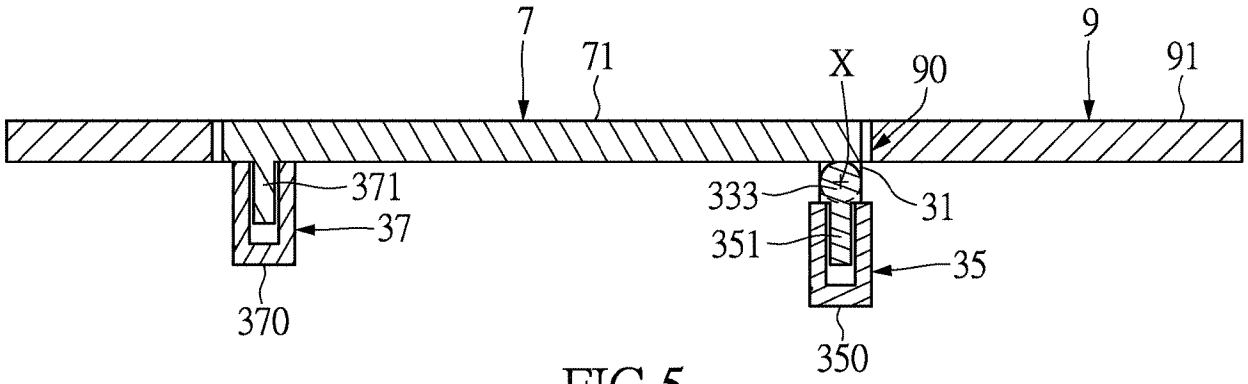
FIG. 5 is a side cross-sectional view showing an assembly having the liftable lid at a close state in accordance with an embodiment of the instant disclosure.
Figure 7:
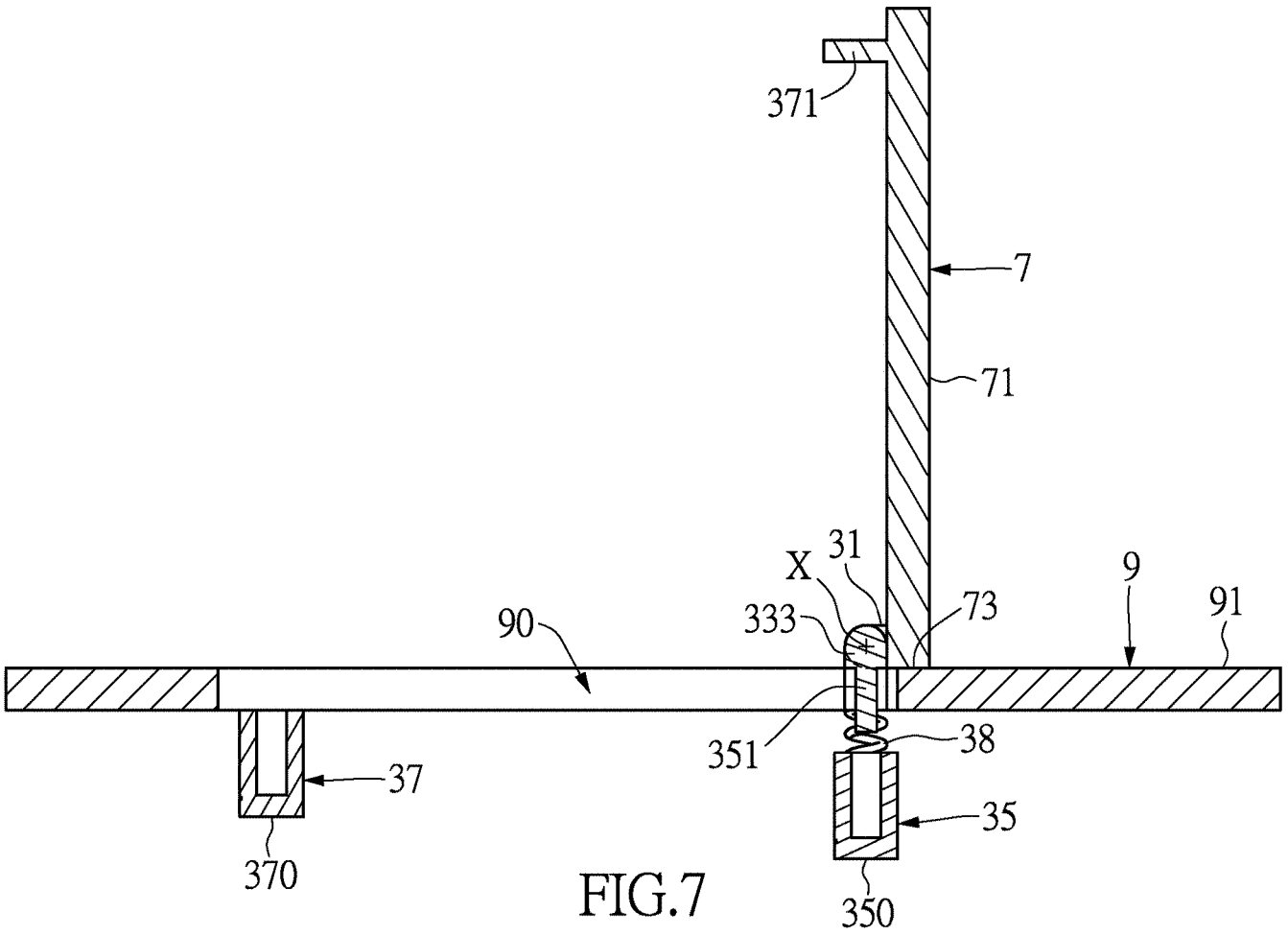
FIG. 7 is a side cross-sectional view showing an assembly having the liftable lid after opening in accordance with an embodiment of the instant disclosure.

It should be noted that the rotating axis X is movably arranged between a close position at the inner side of the surface of the object 9 (as shown in FIG. 5) and an open position at the outer side of the surface of the object 9 (as shown in FIG. 7) and moves thereby. When the rotating axis X is at the close position, the lid 7 closes upon the opening 90 of the object 9 to be at the close state. When the rotating axis X moves away from the close position, the lid 7 is allowed to turn about the rotating axis X and move away from the opening 90 to be at the open state. The rotating axis X correspondingly reaches the open position.

The instant embodiment may further include a pair of latches 35, 37 to secure the lid 7 over the opening 90. However, the latches 35, 37 may be omitted. For example, in the instant embodiment, gravity leads the lid 7 to be in the constant close state. When the lid 7 is to be lifted, a user exerts a force to pull out the lid 7.

Please refer to FIG. 5 (an elastic element 38 is not shown in this figure), in which the lid 7 is in the close state. When the rotating axis X is at the close position, the lid 7 closes upon the opening 90 of the object 9. Preferably, the surface 71 of the lid 7 is co-planar with the surface 91 of the object 9, and the instant disclosure is not limited thereto.

Figure 6:
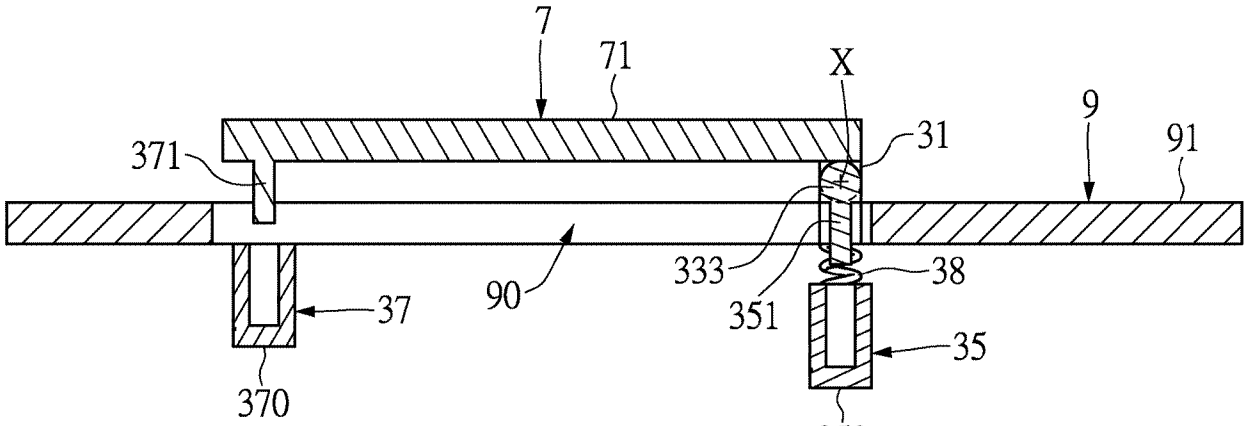
FIG. 6 is a side cross-sectional view showing an assembly having the liftable lid swinging away from an opening of an object in accordance with an embodiment of the instant disclosure.

Please refer to FIG. 6. In the instant embodiment, a push-push latch is exemplified to explain the action of opening. In the process of opening, a force is first exerted to open the lid 7. The lid 7 then moves away from the surface 91 of the object 9 by the push of the elastic element 38.

Please refer to FIG. 7, in which the lid 7 is in the open state. In the instant embodiment, as the lid 7 moves away from the surface 91 of the object 9, a portion of the hinge module 3 (the latch boxes 350, 370 of the latches 35, 37 do not move) moves outwardly away from the outer side of the surface of the object 9. Also, the lid 7 turns about the rotating axis X and away from the opening 90 to an erected open state. However, the angle between the surface 71 of the lid 7 and the surface 91 of the object 9 is not limited to be normal as shown in FIG. 7 in accordance with the instant embodiment. Different angles such as an obtuse angle, acute angle, or 0 degree angle may also be possible as an open state, and FIG. 7 does not intend to limit the angle.

As shown in FIG. 7, the lid 7 turns about the rotating axis X outwardly for approximately 90° to the open state. In the instant embodiment, when the lid 7 is at open state, a side face 73 of the lid 7 only abuts the surface 91 of the object 9. However, the instant disclosure is not limited thereto. The above description is merely an embodiment. The side face 73 can help positioning the lid 7. The contacting area between the side face 73 of the lid 7 and the surface 91 of the object 9 may not be planar and may be in other configurations.

This arrangement in the instant disclosure provides the following benefit: the rotating axis X shifts from the inner side of the surface of the object 9 to the outer side of the surface of the object 9, such that the lid 7 turns outwardly about the rotating axis X formed by the hinge module 3 in order to open. Therefore, unlike the conventional hinge mechanism, the oversized gap L is not formed between the object and the lid. In addition, the hinge module 3 of the instant disclosure is hidden in the inner side of the lid when the lid 7 is closing and does not expose itself so as to maintain the overall aesthetic.

Figure 8:
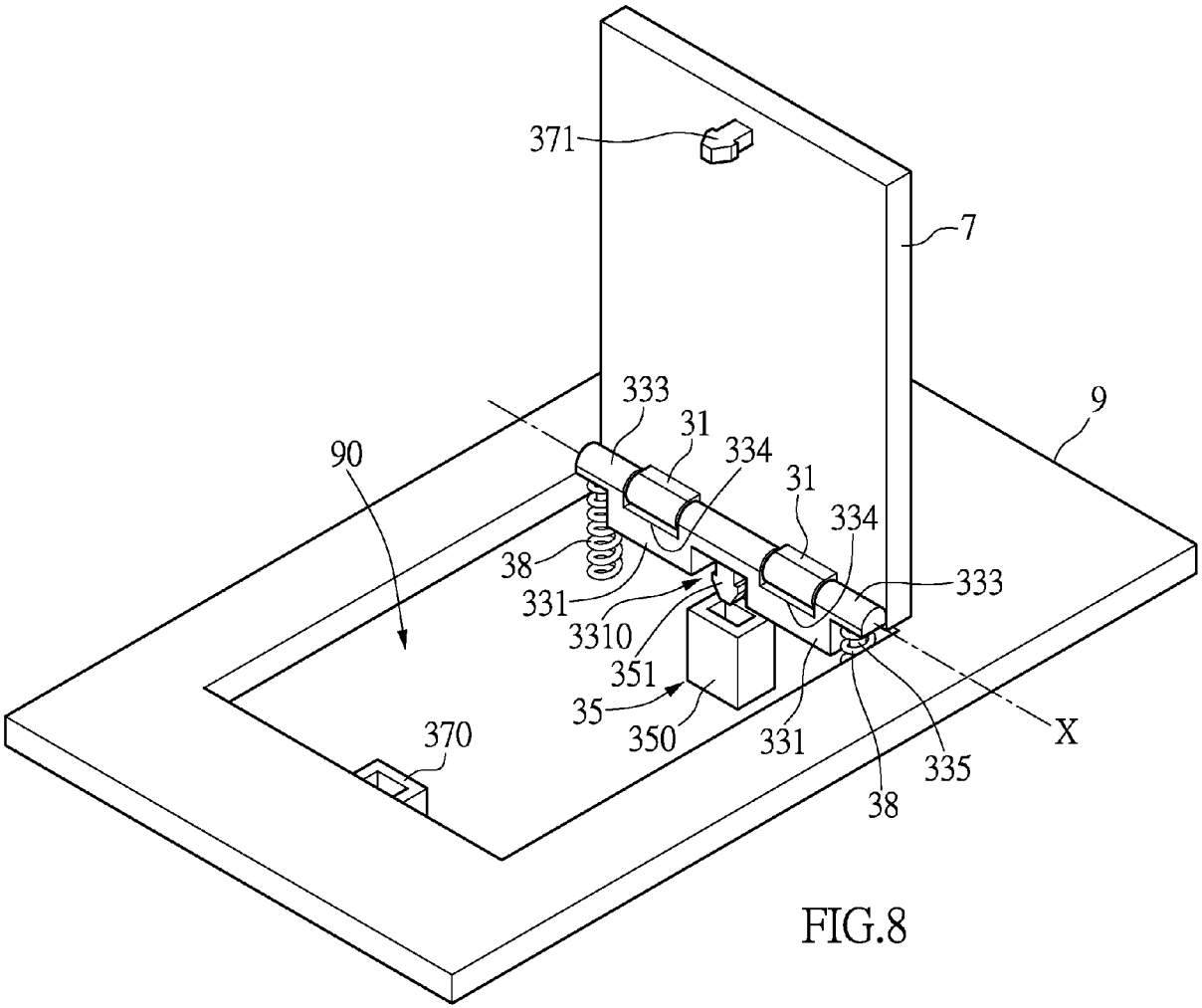
FIG. 8 is a perspective view showing an assembly having the liftable lid after opening in accordance with an embodiment of the instant disclosure.

As shown in FIGS. 4 and 8, preferably, the instant embodiment also includes a pair of elastic elements 38 disposed on two sides of the base 33. The elastic elements 38 allow easier operation when opening the lid 7. One end of the elastic element 38 (as shown in FIG. 4, i.e., the bottom end of the elastic element 38) is engaged to a fixed structure (not shown), for example, the extension of the object 9 or other members below the object 9 is capable of fixing the elastic element 38. The other end of the elastic element 38 (as shown in FIG. 4, i.e., the top end of the elastic element 38) abuts against the base 33 so as to allow the rotating axis X to shift from the close position toward the open position. When the lid 7 closes upon the object 9, corresponding to the rotating axis X at the close position, the elastic elements 38 are compressed to store potential energy. When the latches 35, 37 are unlocked, the elastic elements 38 push the lid 7 to the outer side of the surface of the object by the stored potential energy to facilitate the user to open the lid 7. The elastic element 38 may exert a force that is capable of pushing the lid 7 up to the open state.

In the instant embodiment, the elastic element 38 is a compression spring and is not limited thereto. For example, the elastic element 38 may be a torsion spring or a V-like spring sheet. The torsion spring or an elastic sheet is compressed when the lid is at the close state, and a stored potential energy is provided to push the base 33 from one end of the elastic element. Therefore, the elastic element 38 may provide the force that drives the lid 7 to turn and automatically reach to the open state of the lid 7 after the latches 35, 27 are unlocked. The elastic element 38 may be other kinetic elements. Alternatively, the lid 7 can be lifted by a more efficient way. Specifically, after the lid 7 is unlocked, the user lifts the lid 7 for opening. In this way, the elastic element 38 can be omitted.

Please again refer to FIG. 4. The detail structure of the instant embodiment is elaborated hereinafter. The base 33 includes a main body 331. The top end of the main body 331 is formed with a pair of shaft depression 334 facing the bottom face of the lid 7. Two sides of the main body 331 are formed with an abutting portion 333 respectively. Each of abutting portions 333 has an elastic element 38. Each abutting portion 333 has a downwardly protruding pillar 335 for receiving the compression spring (elastic element 38) sleeved thereon. The pair of shafts 31 are respectively rotatably disposed in the pair of shaft depressions 334, and therefore the shafts 31 and the base 33 collectively define the rotating axis X.

The shaft 31 may be pivoted with respect to the shaft depression 334 by a post or by a pivot (not shown), and the instant disclosure is not limited thereto.

Please refer to FIG. 8. In the instant embodiment, the latch 35 is positioned close to a pivot end of the lid 7 and the latch 37 is positioned close to a lock end of the lid 7 opposite to the pivot end. The pair of the latches 35, 37 is respectively disposed at a bottom face of the base 33 and the bottom face of the lid 7. The latches 35, 37 may be fixed to the inner side of the object 9 or to other structures (not shown) capable of fixing the latches 35, 37. The latch may be a push-push latch. For example, the latch 35 includes a hook 351 connected to the base 33 and a latch box 350 fixedly disposed below the object 9. The hook 351 engages to or disengages from the latch box 350 by a single push. In the instant embodiment, the main body 331 is formed in the middle with a depression 3310 to accommodate the hook 351. When the hook 351 engages to the latch box 350, a portion of the latch box 350 is received in the depression 3310. The latch 37 includes a hook 371 connected to the bottom face of the lid 7 and a latch box 370 fixedly disposed below the object 9.

In the instant embodiment, the pair of latches 35, 37 being push-push latches are used to achieve the advantage described herein: when the user presses the middle region of the lid 7, the two push-push latches (i.e., latches 35, 37) can be unlocked simultaneously, and the lid 7 is released. In addition, the push-push latch itself has an elastic force, such that when the lid 7 is released from the latches 35, 37, the elastic force of the push-push latch is provided to push the lid 7 open in an outward rotation.

However, the latch of the instant disclosure is not limited to the above-mentioned push-push latch, and the latch may be, for example, a tenon latch, a bolt latch (sliding or rotating), a release button, a trigger switch or the like.

Second Embodiment

Figure 9:
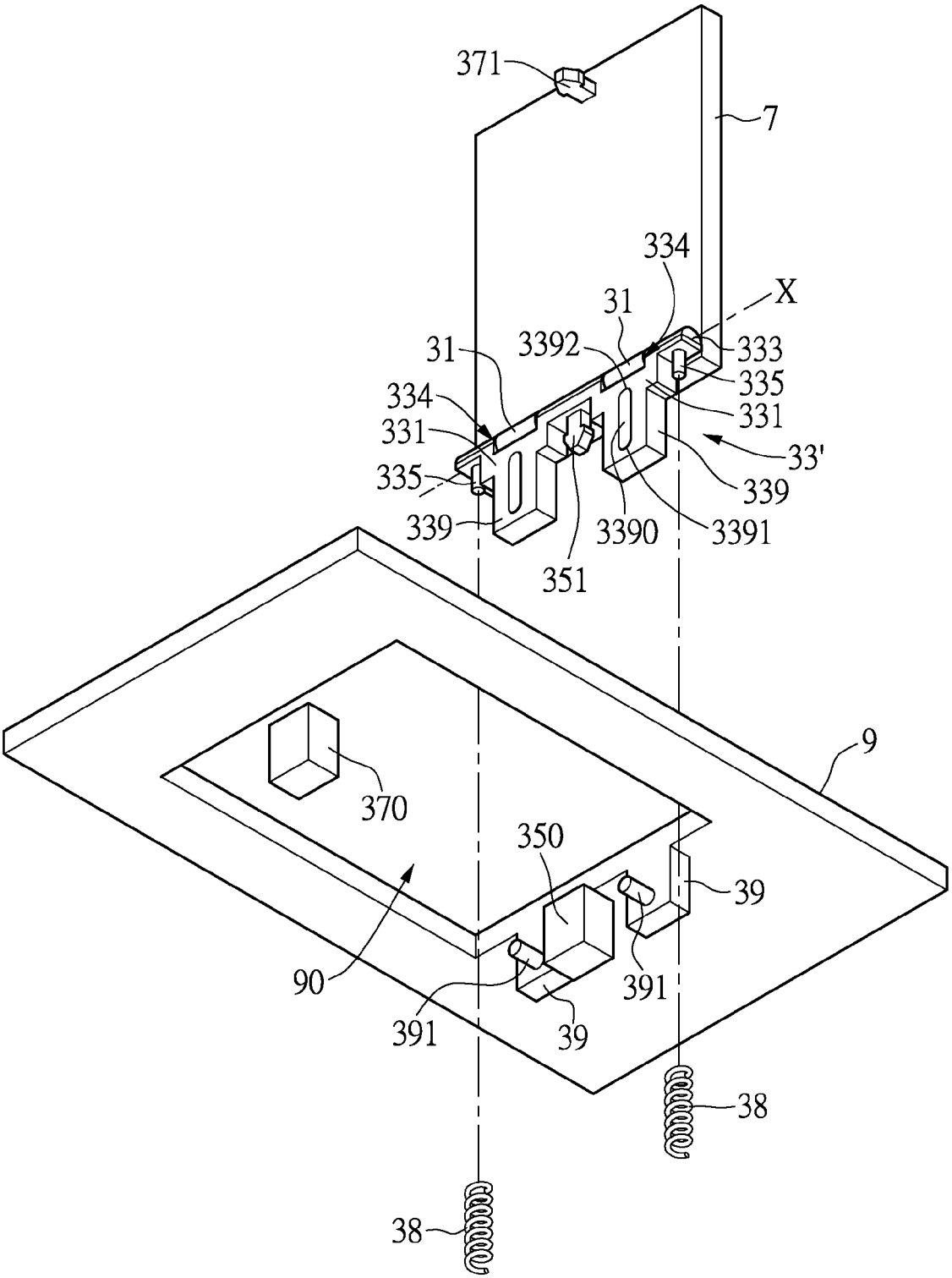
FIG. 9 is an exploded perspective view showing an assembly having the liftable lid in accordance with a second embodiment of the instant disclosure.
Figure 10:
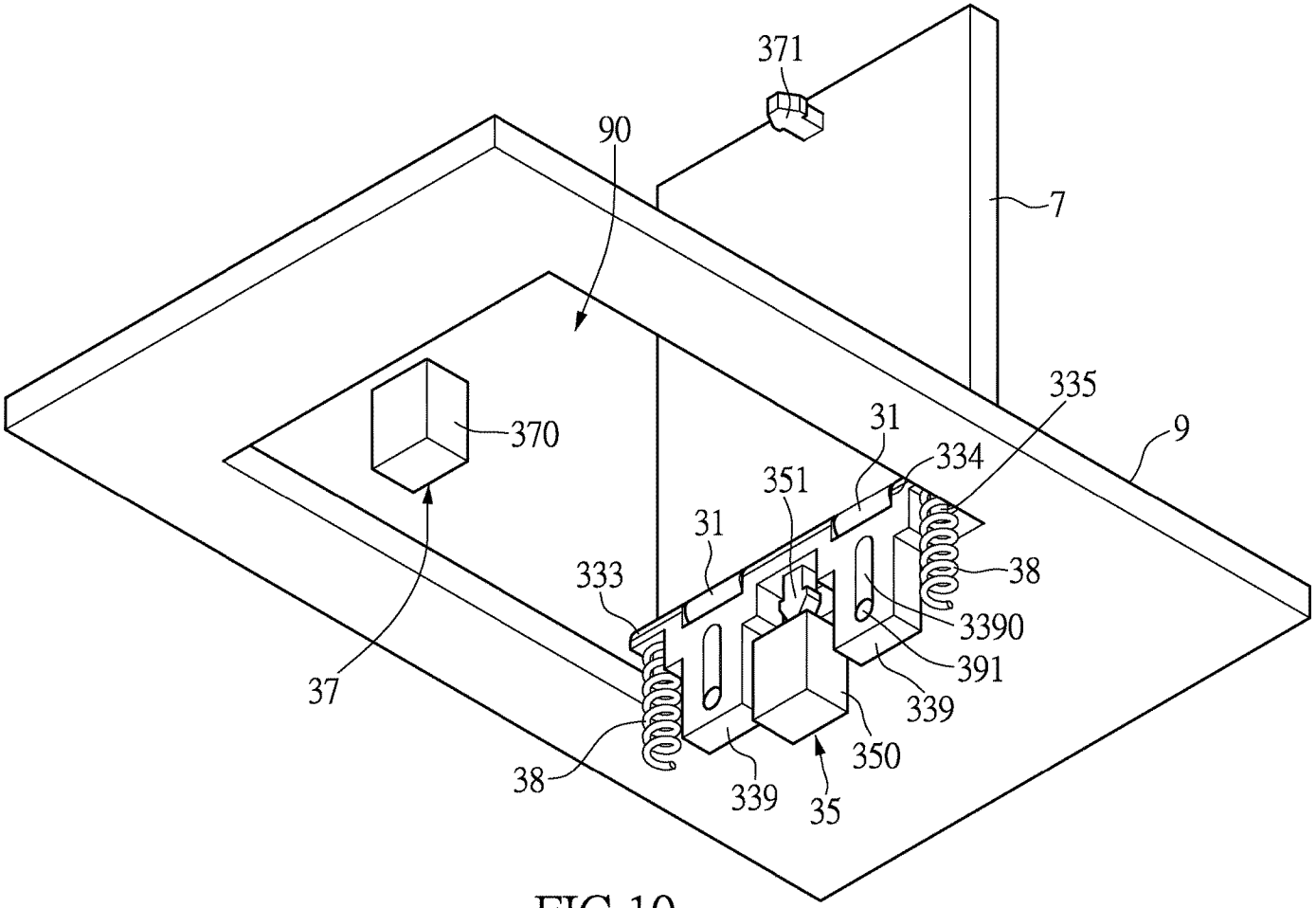
FIG. 10 is an assembled perspective view showing an assembly having the liftable lid in accordance with the second embodiment of the instant disclosure.

Please refer to FIGS. 9 and 10 showing an exploded perspective view and an assembled perspective view in accordance with another embodiment of the assembly having a liftable lid. In the instant embodiment, another approach is implemented to displace the hinge module. FIG. 9 shows that the base 33' of the instant embodiment has a pair of limiting portions 339 extending downwardly from the main body 331. The limiting portion 339 is formed with a limiting slot 3390 at a center portion of the limiting portion 339. The bottom face of the object 9 further includes a pair of limiting blocks 39 that may extend from the bottom face of the object 9 or may be provided by other structures. Each of the limiting blocks 39 has a limiting post 391. The limiting post 391 is movably disposed in the limiting slot 3390. When the limiting post 391 moves to the first end 3391 of the limiting slot 3390, the rotating axis X is positioned to the open position. When the limiting post 391 moves to the second end 3392 of the limiting slot 3390, the rotating axis X is positioned to the close position.

However, the displacement of the hinge module is not limited to the abovementioned embodiment. For example, the bottom face of the main body 331 may be extended to form a limiting arm (not shown) close to the latch box 350. The limiting arm extends downwardly along the side of the latch box 350 and engages to the bottom of the latch box 350 to limit the movement of the hinge module.

In summary, the instant disclosure provides a movable hinge module, such that the lid 7 is pivotally connected to the object 9 over the opening 90 in a rotatably open or close manner. When the lid 7 closes, the hinge module 3 enters underneath the surface 91 of the object 9 so as to reduce any negative effect on the overall appearance caused by the hinge module. When the lid 7 opens, the hinge module 3 is pushed out to the surface 91 of the object 9 by a force so as to provide the lid 7 with more rotation space. The movable hinge module of the instant disclosure can be adapted to any kinds of rotation assembly for opening and closing. The advantages are that the space is more efficiently used and the overall product aesthetics is not affected. The structure of the instant disclosure is simple, and the assembly process is simplified. Unlike the conventional technique, the lid is fully open and the product aesthetic with the lid is not compromised.

Figure 11:
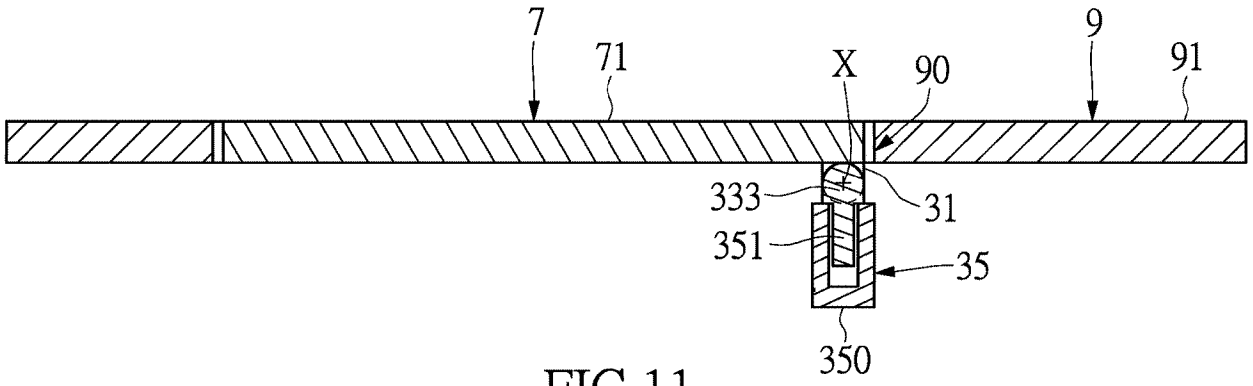
FIG. 11 is a side cross-sectional view showing an assembly having the liftable lid at a close state in accordance with another embodiment of the instant disclosure.
Figure 12:
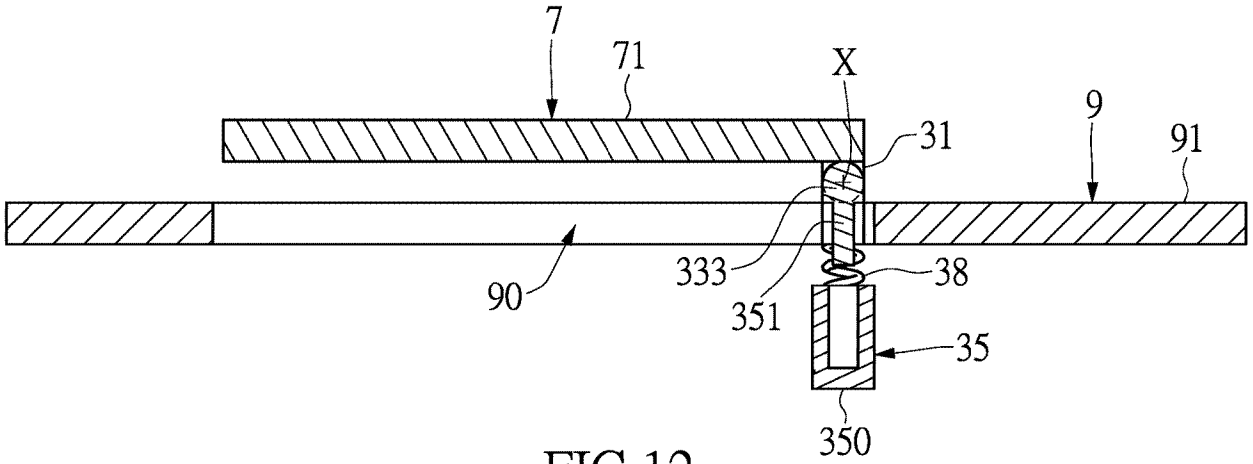
FIG. 12 is a side cross-sectional view showing an assembly having the liftable lid at an unlock state in accordance with another embodiment of the instant disclosure.
Figure 13:
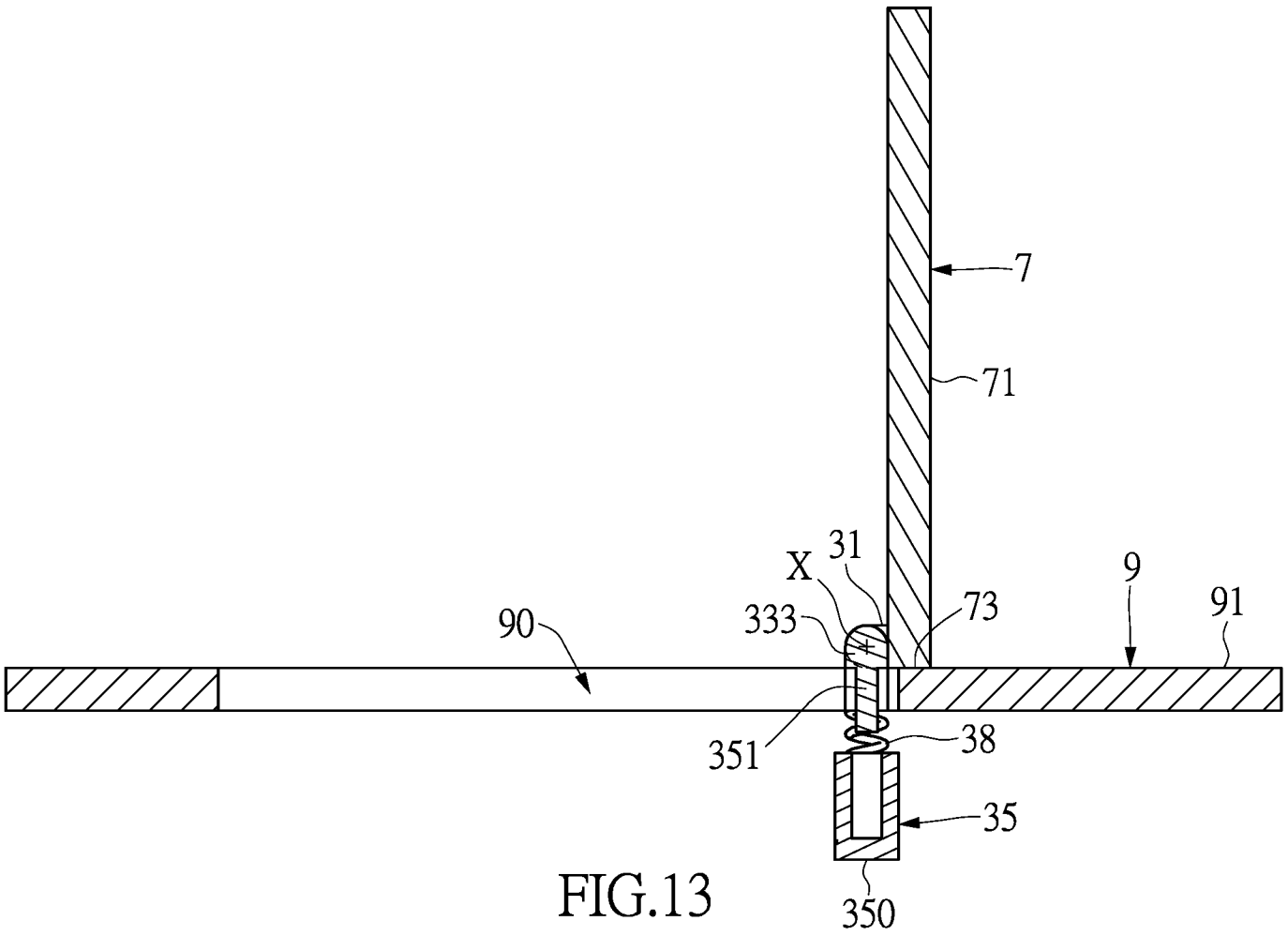
FIG. 13 is a side cross-sectional view showing an assembly having the liftable lid after opening in accordance with another embodiment of the instant disclosure.

It should also be noticed that the number of the shaft of the hinge module is not limited to a pair. The number of shafts may be at least one, or more than two. The at least one shaft is rotatably connected to the base, and the shaft and the base collectively define a rotating axis X. Likewise, the number of the latch is not limited to a pair. The latch may be at least one lock to maintain the lid to the close state. A single latch may be disposed close to the lock end of the lid 7 and extending to the pivot end of the lid. By operating the latch disposed at the lock end of the lid, both the lock end and the pivot end of the lid are unlocked. Another embodiment of a single latch 35 positioned close to the pivot end of the lid 7 is illustrated in FIG. 11 to FIG. 13. Similar to the description of FIG. 5 to FIG. 7, the lid 7 is in the close state in FIG. 11, and a force is first exerted to open the lid 7 in FIG. 12, and the lid 7 then moves away from the surface 91 of the object 9 by the push of the elastic element 38. Referring to FIG. 13, the lid 7 moves away from the surface 91 of the object 9, and turns about the rotating axis X and away from the opening 90 to an erected open state.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A movable hinge module for pivotally connecting a lid over an opening of a surface of an object, the lid being rotatable when opening or closing with respect to the opening, the hinge module comprising:

at least one shaft connected to the lid;

a base, wherein the at least one shaft is rotatably connected to the base, and the at least one shaft and the base collectively define a rotating axis; and a kinetic component connected to the base; wherein the kinetic component moves the shaft from an inner side of the opening on the object toward an outer side of the opening on the object when the kinetic component is activated;

at least one latch fastening the lid at the opening;

wherein when the shaft is at the inner side of the opening on the object that is a close position, the lid closes upon the opening of the object as a close state; and wherein when the shaft moves away from the close position to be at the outer side of the opening on the object that is an open position, the lid rotates along the rotating axis and moves away from the opening to an open state.

2. The movable hinge module according to claim 1, wherein the kinetic element is at least one elastic element.

3. The movable hinge module according to claim 2, wherein the base comprises a main body, the main body having at least one shaft depression, the at least one shaft is rotatably disposed in the shaft depression, each of two sides of the base has an abutting portion, and each of the abutting portions has the elastic element.

4. The movable hinge module according to claim 1, wherein the number of the at least one latch is a pair, one to latch the base against the object, and an opposed one to latch a free end of the lid.

5. The movable hinge module according to claim 4, wherein the main body further comprising:

a pair of limiting portions downwardly extending from the main body, each limiting portion having a limiting slot thereon, and wherein the limiting slot has a first end and a second end; and wherein the object further comprising a pair of limiting blocks below the bottom face of the object; wherein each limiting block has a limiting post movably disposed in the limiting slot; and wherein when the limiting post moves to the first end of the limiting slot, the rotating axis is at the open position, and when the limiting post moves to the second end of the limiting slot, the rotating axis is at the close position.

6. The movable hinge module according to claim 1, wherein when the lid is arranged at the close state, a circumferential region of a surface of the lid is flushed with the surface of the object.

7. An assembly having a liftable lid comprising:

an object having a surface with an opening;

a lid rotatably arranged upon the opening;

a movable hinge module including:

at least one shaft connected to the lid;

a base, wherein the at least one shaft is rotatably connected to the base, and the at least one shaft and the base collectively define a rotating axis; and a kinetic component connected to the base; wherein the kinetic component moves the shaft from an inner side of the opening on the object toward an outer side on the object when the kinetic component is activated; and at least one latch fastening the lid at the opening;

wherein when the shaft is at the inner side of the opening on the object that is a close position, the lid closes upon the opening of the object as a close state; and wherein when the shaft moves away from the close position to be at the outer side of the opening on the object that is an open position, the lid rotates along the rotating axis and moves away from the opening to an open state.

8. The assembly according to claim 7, wherein the kinetic element is at least an elastic element.

9. The assembly according to claim 8, wherein the base comprises a main body, the main body having at least one shaft depression, the shaft is rotatably disposed in the shaft depression, each of the two sides of the base has an abutting portion, and each of the abutting portion has the elastic element.

10. The assembly according to claim 7, wherein when the lid is at the close state, a circumferential region of a surface of the lid is flushed with the surface of the object.

11. The assembly according to claim 7, wherein the number of the at least one latch is a pair, one to latch the base against the object, and an opposed one to latch a free end of the lid.

12. The assembly according to claim 11, wherein the main body further comprising:

a pair of limiting portions downwardly extending from the main body, each limiting portion having a limiting slot thereon, and wherein the limiting slot has a first end and a second end; and wherein the object further comprising a pair of limiting blocks below the bottom face of the object; wherein each limiting block has a limiting post movably disposed in the limiting slot; and wherein when the limiting post moves to the first end of the limiting slot, the rotating axis is at the open position, and when the limiting post moves to the second end of the limiting slot, the rotating axis is at the close position.

13. The assembly according to claim 8, wherein the at least one shaft is connected to a bottom face of the lid, and the at least one elastic element positioned between the base and the object.

14. The assembly according to claim 10, wherein when the lid is at the open state, a portion of the lid is on top of the surface of the object.

15. The assembly according to claim 11, wherein one of the latches is a push-push latch and includes a hook connected to the base and a latch box, the hook engages to or disengages from the latch box, the other latch is a push-push latch and includes another hook connected to the bottom face of the lid, and the other hook engages to or disengages from the latch box.

16. An assembly having a liftable lid comprising:

an object having a surface with an opening;

a lid rotatably arranged upon the opening;

a movable hinge module including:

at least one shaft connected to the lid;

a base, wherein the at least one shaft is rotatably connected to the base, and the shaft and the base collectively define a rotating axis; and a kinetic component connected to the base; and at least one latch fastening the lid at the opening;

wherein the rotating axis moves by the kinetic component between an inner side of the opening on the object and an outer side of the opening on the object, when the kinetic component is activated;

wherein when the rotating axis is at the inner side of the opening on the object that is a close position, the lid closes upon the opening of the object as a close state; and wherein when the rotating axis moves away from the close position to be at the outer side of the opening on the object that is an open position, the lid rotates along the rotating axis and moves away from the opening to an open state.

17. The assembly according to claim 6, wherein when the lid is at the open state, a portion of the lid is on top of the surface of the object.

* * * * *